United States Patent [19]

Allen

[11] 4,356,882

[45] Nov. 2, 1982

[54] DEVICE FOR ENLARGING THE EFFECTIVE VOLUME OF A LOUDSPEAKER ENCLOSURE

[76] Inventor: James C. Allen, 14 Lovejoy Rd., Andover, Mass. 01810

[21] Appl. No.: 225,418

[22] Filed: Jan. 15, 1981

[51] Int. Cl.[3] ..... H04R 1/28

[52] U.S. Cl. ..... 181/151; 181/156

[58] Field of Search ..... 179/1 E; 181/146, 148–156, 181/199, 166

[56] References Cited

U.S. PATENT DOCUMENTS

| | | | |
|---|---|---|---|
| 2,797,766 | 7/1957 | Sullivan | 181/151 |
| 3,917,914 | 11/1975 | Parker | 179/114 M |
| 4,004,094 | 1/1977 | Ott | 181/151 X |
| 4,101,736 | 7/1978 | Czerwinski | 181/151 X |

OTHER PUBLICATIONS

*Mechanics, Heat and Sound,* E. W. Sears, pp. 410–429.
*Modern Physics,* P. A. Tipler, pp. 59–63.
*Thermal Physics,* C. Kittel and H. Kromer, pp. 334–341.
*Physical Chemistry,* P. Atkins, pp. 87–88.
*Heat and Thermodynamics,* Zemansky, pp. 279–287.

*Primary Examiner*—Joseph W. Hartary

*Assistant Examiner*—Thomas H. Tarcza

[57] ABSTRACT

The present invention is a device for use in combination with a loudspeaker system, that includes a speaker enclosure, in order to effectively enlarge the volume of the speaker enclosure thereby increasing the apparent compliance of the speaker enclosure. The loudspeaker system also includes a vibratable cone. The device may also permit the varying of the mass of the moving system with respect to frequency. The device for effectively enlarging the volume of the speaker enclosure includes a gas having a Joule-Thomson coefficient of less than zero above its inversion temperature, and an inversion temperature below the ambient temperature of the environment in which the device is to be used. The device also includes a displaceable walled container, or a bag or sack which is formed from a soft and pliable material, having an expansible and contractable volume which is used for enclosing the gas within the speaker enclosure and which is adapted to seal the gas therein, being substantially permeable to mechanical vibrations, but substantially impermeable to the gaseous mediums on either side thereof. The device is placed in the speaker enclosure in back of the vibratable cone in order to increase the compliance that the vibratable cone sees.

6 Claims, 9 Drawing Figures

(Inversion Temperature)
— Hydrogen
..... Helium
-·-·- Air ($O_2$, $N_2$)

DEVICE FOR ENLARGING THE EFFECTIVE VOLUME OF A LOUDSPEAKER ENCLOSURE

BACKGROUND OF INVENTION

1. Field of Invention

This invention relates to enclosure systems associated with sound producing devices and more specifically to vibratorily-driven, sound producing membranes, and more particularly to a device for effectively enlarging the volume of a speaker enclosure of a loudspeaker system in order to increase the compliance that a vibratable cone sees. This device may also permit the varying of the mass of the moving system with respect to frequency.

2. Description of Prior Art

Various sound producing generators, such as audio speakers, operate by driving a membrane in physical vibrations. The vibrating membrane radiates oppositely directed waves in a gaseous medium consisting of alternate regions of increased and decreased pressure. Unfortunately, these front-waves and backwaves can be transmitted through the air to intersect and cause interference, particularly destructive interference.

The more conventional approaches toward the solution of this problem have been to mount the vibratorily-driven membrane at a port provided in the wall of an enclosure. The enclosure is designed either to eliminate the backwaves by absorbing their energy within the enclosure, or by directing the backwaves through passageways and baffles and then transmitting them out of the enclosure in a manner intended to provide only constructive interference with the front waves.

One problem with the first-mentioned solution is that a substantial amount of energy which is used to drive the vibrating membrane is wasted by subsequent absorption in the enclosure. This also cuts the effective efficiency of the sound producer in half by absorbing half of the sound energy produced.

Another problem which increases as a speaker and/or enclosure becomes smaller is that substantial back pressures are exerted against the vibrating membrane by the gas, usually air, within the enclosure.

This back pressure retards the movement of the membrane and results in nonlinear response of the speaker system, especially at lower frequencies where long wavelengths require large membrane excursions. This effect degrades the quality of the sound being reproduced.

A problem with the sound described reflex system is that it is frequency-responsive and consequently constructive interference cannot be uniformly maintained over the broad spectrum of audio frequencies; and, there is a lack of proper mechanical damping of the vibrating membrane, and therefore there is an accompanying degradation of the quality of the sound reproduced.

A problem with both of these designs is that each has a fixed mass in the vibrating system which constrains the designer of the system to make compromises in the design, limiting the width of the response any one design can have.

The less conventional approaches toward a solution to these problems deal with using, in place of air, gases with a [$\gamma$] gamma of less than 1.4 which will have an adiabatic compressibility greater than that of air, or liquid→vapor equilibrium systems.

U.S. Pat. No. 3,905,448 entitled Loudspeakers, issued to Hirotake Kawakami, Toshio Sasabe, Toshio Hirosawa, Nobuyuki Arakawa, Kozo Kokubu, Kazumasa Abe and Toshiko Harashino on Sept 16, 1975 teaches a loudspeaker of a general type having a vibratable cone diaphragm.

In Applied Acoustics, H.F. Olsen and F. Massa discuss a back-enclosed cone of a loudspeaker system on pages 197 and 198, the following is an excerpt from that discussion:

> "In general, cone speakers are used with both sides of the cone open so that radiation into the air takes place from both sides. For certain uses, as for example a standard source of sound for microphone calibration, reverberation measurement, it is desirable to enclose the speaker mechanism in a box and thus confine the radiation from the cone. The important factor in this system is the stiffness introduced by the box. The net result of this added stiffness is an attenuation of the low-frequency response. A specific example will illustrate the important factors in this system."

In the specific example, the velocity of the cone is given by the equation:

$$X = \frac{f_m}{r_m + j\omega m + \frac{1}{j\omega C_m}}$$

where $f_m$=Bli=b(flux density in the air gap)l(length of wire in the voice coil)i(current in the voice coil), $r_m$=radiation resistance, m=mass of the cone, voice coil and air load, $C_m=C_{m1}+C_{m2}=C_{m1}$(compliance of the center and suspension system of the cone)+$C_{m2}$-(compliance of the box enclosing the back of the cone).

Another except for Applied Acoustics follows:

> "From a consideration of the equation it will be seen that above the resonant frequency the velocity of the system is inversely proportional to the frequency; therefore, since [$r_m$] is proportional to the square of the frequency, the power output will be independent of the frequency. Below the resonant frequency the velocity is limited by the compliances [$C_{m1}$] and [$C_{m2}$] and the velocity of the cone is practically proportional is rapidly attenuated with decreasing frequency.
>
> Therefore, the low-frequency response limit will be determined by the resonant frequency of the system.
>
> If [$C_{m2}$] is large compared to [$C_{m1}$], then the compliance of the box will not materially affect the response and the action will be practically the same as that with both sides open to the air. If the resulting volume when the condition is satisfied is too large and cumbersome, then the system must be altered."

This excerpt demonstrates the effect that the compliance of the enclosure has on the position of the resonant frequency of the system and, since it is preferred that a speaker system have a very low-frequency resonance, it is necessarily preferred that a speaker system enclosure have a very high compliance while maintaining a reasonable enclosure volume. The discussion in Applied Acoustics also notes the effect of the mass of the vibrating system on the resonant frequency and states than an increase in mass will result in a decrease in the resonant frequency. Therefore, a large mass is preferred for the low frequencies but a light mass is required for efficient reproduction of higher frequencies; therefore, it is necessarily preferred that the mass of the vibrating system vary with respect to the frequency reproduced.

U.S. Pat. No. 4,101,736 issued to Eugene Czerwinski on July 18, 1978 teaches a speaker enclosure with an enclosed gas; the following is an excerpt:

"Such an increase in the effective volume is obtained in adiabatic compression,"

It is known then that the effective compliance inside a speaker enclosure is proportional to the adiabatic compressibility of the gas therein.

In Mechanics, Heat and Sound by Francis Weston Sears the adiabatic compressibility of an ideal gas is discussed, wherein on page 428 he sets out the following equation:

$$k_{AD}=1/\gamma P$$

where $K_{AD}$ is the coefficient of adiabatic compression, $\gamma$ is the ratio $C_p/C_v$, and p is the pressure of the gas. It is also known that real gases do not obey this law and can deviate greatly from ideal behavior.

In Physical Chemistry by Paul Atkins the deviation from ideal behavior of real gases is discussed on pages 87–88, the following is an excerpt in reference to the Joule-Thomson effect and the Joule-Thomson coefficient $\mu_{JT}$:

"Real gases have non-zero coefficients. This can be anticipated from everyday experience because gas issuing from a small orifice (e.g., a bicycle pump or a compressed-air cylinder) is noticeably cooler than the ambient temperature.

The sign of the coefficient may be positive or negative. A positive sign implies that dT is negative when dp is negative, in which case the gas cools on expansion. A negative sign implies that dT is positive when dp is negative, and so the gas is heated upon expansion. The sign and magnitude of $\mu_{JT}$ depends on the gas and the conditions. Gases showing heating effects ($\mu_{JT}<0$) show a cooling effect ($\mu_{JT}>0$) below their inversion temperatures . . .

:using Helium at room temperature would turn a refrigerator into an expensive oven.

For an ideal gas (or a real gas behaving ideally) the Joule-Thomson coefficient is zero."

The formula for the Joule-Thomson effect is:

$$\mu_{JT}=(\delta T/\delta P)_H$$

According to this statement a gas with a Joule-Thomson coefficient of less than zero, undergoing an adiabatic expansion increases in temperature and so, conversely, this gas will cool during an abiabatic compression. This drop in temperature makes up for the increase in pressure incurred in the compression and there is, therefore, no net increase in pressure. Although work is being done and energy is required, the work is approximately linear during this process. The degree to which the Joule-Thomson effect occurs can be graphically demonstrated by referring to a graph of the inversion temperature as a function of pressure and temperature such as those in Heat and Thermodynamics by Zemansky.

The graph of the inversion temperature for the gas Hydrogen in reproduced in FIG. 9, of the drawings. On this PT diagram there is a curve such that, for all values of PT outside the curve $\mu_{JT}$ is negative, and for all values of PT inside the curve $\mu_{JT}$ is positive. This PT graph is called an "inversion curve."

Hydrogen and Helium are the only gases readily available with inversion temperatures at or below the ambient temperature of the human environment.

It will be found that a gas with a negative Joule-Thomson coefficient will have a very high adiabatic compressibility, yet will have a relatively low isothermal compressibility; therefore, at mid to low frequencies the compliance of this gas is very high, but at ultra-low-frequencies in which the compression process is isothermal the compliance is very low and the response of the loudspeaker system is limited at infrasonic frequencies. As will be seen in the preferred embodiment of this invention, this is a very advantageous situation when applied to loudspeaker technology.

U.S. Pat. No. 2,797,766 entitled Loudspeaker, issued to H.W. Sullivan on July 2, 1957 teaches an airtight enclosure containing an acoustic diaphragm is provided with a membrane substantially permeable to mechanical vibrations, but substantially impermeable to the gaseous medium on either side of the membrane. The acoustic diaphragm vibrates in a gaseous medium which is heavier than air and in which sound travels at a slower speed than in air; referring back to Mechanics, Heat and Sound on page 498 the following equation is set out:

$$V^2=(\gamma)(P/_e)$$

Where $\gamma$ is the speed of sound in a gas, $\gamma$ is as previously described, p is the pressure of the gas, and $\rho$ is the density of the gas. The characteristic impedance of the diaphragm in the gaseous medium and the acoustical capacitance are lower than those prevailing in air. The difficulty with this design is that the acoustical capacitance of the enclosure still cannot be lowered sufficiently to be considered a preferred speaker enclosure and in a closed enclosure it is the acoustical capacitance which leads to the nonlinear movement of the vibratorily-driven cone or membrane. Also the velocity of sound, being slower than that prevailing in air, leads to highly delayed reflections inside the speaker enclosure, therein degrading the quality of the sound reproduced.

U.S. Pat. No. 4,004,094 entitled Enclosure System for Sound Generators, issued to James Ott on Jan. 18, 1977, teaches a device for use in an enclosure associated with an audio speaker which permits relatively large volume changes within the enclosure as a result of relatively small pressure changes so that relatively small enclosures can be as effective as larger volumes. The device reduces the energy required from the speaker to change the volume of the interior of the enclosure. Pressure perturbations caused by the movement of the vibratorily-driven membrane of the sound producing device cause alternate condensation and vaporization of a composition of matter to minimize back-pressure. The gas-liquid equilibrium is the key to the operation of this device. The patent teaches an improvement in a sound production system which has a less than perfectly sealed enclosure with a flexibly walled container contained therein. The container has a contractable and expandable volume and contains a composition of matter having an equilibrium state between a gas and a liquid phase. Similarly, U.S. Pat. No. 4,101,736 issued to Eugene Czerwinski on July 18, 1978, teaches an improved version of the proceding two patents consisting of a device for enlarging the effective volume of a speaker enclosure including a gas having a gamma $\gamma$ of less than 1.4 and the product of its density and the square of the speed of sound therein less than the same product for air and a bag which is formed from a soft, pliable material for enclosing the gas within the speaker enclosure and which is adapted to seal the gas therein. The device also includes an acoustically transparent and porous cocoon which is disposed about the bag so that it surrounds completely the bag and an acoustical padding which is disposed adjacent to the sidewalls of the speaker enclosure and which is adapted to enclose the acoustically transparent and porous cocoon. The device may also include a device for generating the gas by heating a fluid in its liquid phase so that the fluid changes to its gas phase. The device is placed in the speaker enclosure in back of the vibratable cone in order to increase the compliance that the vibratable cone sees.

The difficulty with this design is that the preferred speaker enclosure should be unaffected by position, in this design both the surface area of the fluid and its proximity to the heating element therein affect the performance of the device adversely and dictates the necessary orientation, or position, of the enclosure; i.e., upright, sideways, upside down, etc. Another difficulty with this design is the lowered speed of sound in the gas with a gamma of less than 1.4 which leads to delayed reflections from inside the enclosure increasing the inherent distortion and, therefore, degrading the quality of the reproduced sound. Another difficulty with this design (in reference to the preferred speaker enclosure) is the existence of a venting port so that there is a source of high velocity air against the back of the diaphragm of the loudspeaker. Although this design has improved efficiency compared to that of a sealed enclosure, the lack of proper mechanical damping seen by the vibrating diaphragm leads to the generation of a resonance peak over a low-frequency region, which increases the inherent distortion and degrades the quality and accuracy of the sound being reproduced. This lack of proper mechanical damping can lead to very large excursions of the vibrating diaphragm at very low frequencies such as those associated with warped records which can cause eventual breakdown of the vibrating diaphragm, as well as wasting valuable amplifier power on unwanted signals.

There is, therefore, a need for an enclosure system for use with vibratorily-driven sound producing membranes which can effectively dissipate or absorb the backwaves therein without significant pressure variations within the enclosure in order to minimize the input energy required to overcome these backwaves, and to provide a linear effective acoustic resistance in place of the nonlinear acoustic capacitance inherently representative of the interior volume of the speaker enclosure—while raising the compliance of the box to a value practically the same as both sides of the vibratorily-driven membrane being open to the air, and while providing the proper linear mechanical damping of the membrane which will result in a maximally wide, flat response curve over a wide power range and preventing damage to the vibrating diaphragm from unnecessarily large excursions in response to unwanted ultra low-frequency signals. There is also a need for a device containing a gaseous medium in which the speed of sound is as high as is possible so as to bring the time delay of internal cabinet reflections in the mid to high frequency range to a minimum.

SUMMARY OF THE INVENTION

In view of the foregoing factors and conditions characteristic of the prior art it is an object of the present invention to provide a device for a loudspeaker system that increases the effective volume for improved low-frequency response of its speaker enclosure.

It is another object of the present invention to provide a device for a loudspeaker system that increases the compliance that its vibratable membrane or cone sees for a particular volume of its speaker enclosure.

It is still another object of the present invention to provide a device for a loudspeaker system that enables the speaker enclosure to be reduced in volume and to still respond accurately and efficiently to the desired low-frequency limit.

It is still another object of the present invention to provide a device for a loudspeaker system that enables the containment of a gas within the speaker enclosure in which the speed of sound is greater than that prevailing in air, decreasing the time delay of the sound reflections within the speaker enclosure.

It is still another object of the present invention to provide a device for a loudspeaker system which provides proper mechanical damping for the vibratable cone or membrane while retaining its efficiency at low frequencies while preventing response to infrasonic frequencies whose excursions might damage said vibratable membrane or cone.

In accordance with an embodiment of the present invention a device for use in combination with a loudspeaker system, that includes a speaker enclosure, in order to effectively enlarge the volume and lower the acoustical capacitance of the speaker enclosure, and a device which varies the mass of the vibrating system with respect to frequency has been described.

The loudspeaker system also includes a vibratable membrane or cone. The device for effectively enlarging the volume of the speaker enclosure includes a gas having a Joule-Thomson coefficient of less than zero above its inversion temperature and an inversion temperature at or below the ambient temperature of the environment in which the device is to be used.

The device also includes either a displaceable walled container, or a sack or bag which is formed from a soft and pliable material, having an expansible and contractable volume which is used for enclosing the gas within the speaker enclosure and which is adopted to seal the gas therein, being substantially permeable to mechanical vibrations, but substantially impermeable to the gaseous mediums on either side thereof. The displaceable portions of said containers have a mass which varies with respect to the applied frequency. The device is placed in the speaker enclosure in back of the vibratable membrane or cone in order to increase the compliance that the vibratable cone sees.

The features of the present invention which are believed to be novel are set forth with particularity in the appended claims.

Other objects and many attendant advantages of the present invention will be more readily appreciated as the same becomes better understood by reference to the following detailed description and considered in connection with the accompanying drawings in which like reference symbols designate like parts throughout the figures.

DESCRIPTION OF THE PREFERRED EMBODIMENT

Figure 1:
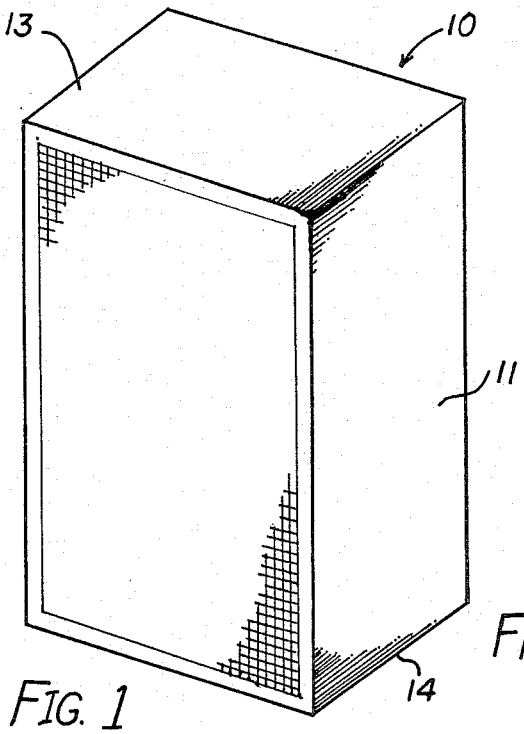
FIG. 1 is a perspective view of a loudspeaker system that has a speaker enclosure of the closed or vented box type and that has a device for effectively enlarging the volume of the speaker enclosure which is constructed in accordance with the principles of the present invention.
Figure 2:
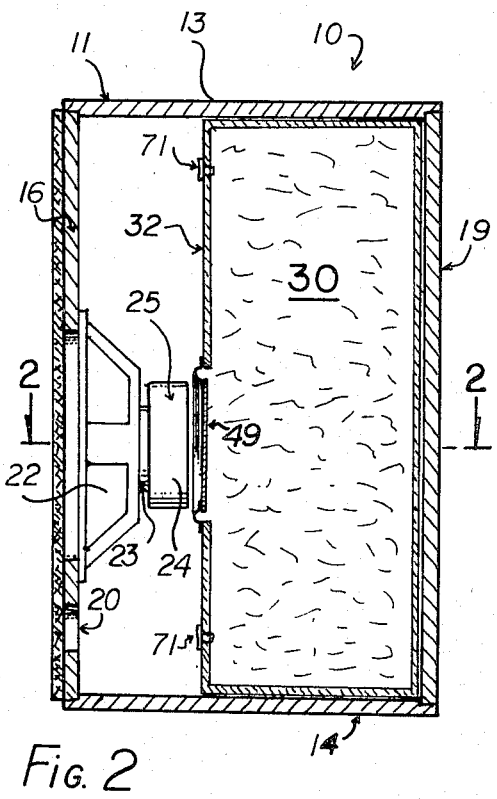
Figure 4:
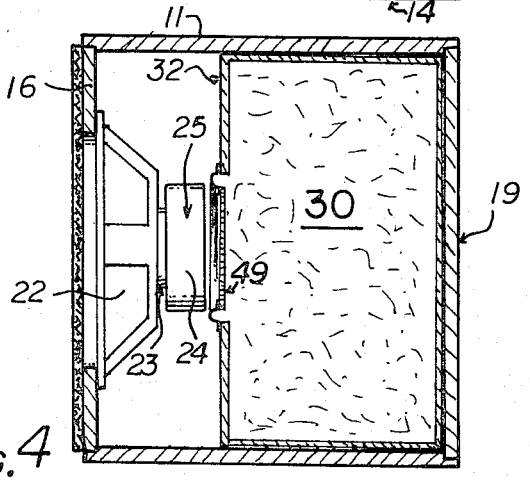
FIG. 4 is a vertical cross-sectional view of the speaker enclosure of FIG. 1 taken along line 2—2 of FIG. 2.

The present invention can best be understood by reference to a description of its preferred embodiments and to the showings in the drawing. The invention is an improvement for use in combination with a loudspeaker system 10 shown in FIG. 1 to effectively enlarge the volume of a speaker enclosure 11 so that its vibratable cone 22 sees a larger compliance than it sees without the improvement. Referring now to FIG. 2, the speaker enclosure 11 includes a top 13, a bottom 14, a pair of sides 15 and a front 16 having a speaker port. The loudspeaker system 10 includes a vibratable cone 22 which is disposed within the speaker port. The side cross-sectional view of the speaker enclosure 11 also reveals that its front 16 may have a port opening 20 so that there is source of high velocity air against the back of the diaphragm of the loudspeaker such as in a bass-reflex type of enclosure, or the port may be closed in which case the enclosure is that of the acoustic-suspension type. A standard loudspeaker which is described in U.S. Pat. No. 3,917,914, entitled Loudspeaker, issued to Rollin James Parker on Nov. 4, 1975 and which is also described in any one of a number of patents covering loudspeakers includes, in addition to the vibratable cone 22, a ring magnet 25 positioned in its peripheral circular surface within and in solid contact with the apex of the vibratable cone 22, a magnet circuit 23 positioned within the ring of the magnet 25 but not in direct contact therewith, with the magnet 25 extending interiorly of the vibratable cone 22, an electromagnetic coil 24 mounted on the magnetic circuit 23 and a device for positioning the vibratable cone 22, the ring magnet 25, the magnetic circuit 23 and the electromagnetic coil 24 whereby the ring magnet 25 and the vibratable cone 22 are vibratable in response to an electrical signal impressed on the electromagnetic coil 24.

Still referring to FIG. 2, the improvement to the loudspeaker system 10 is the use of a gas 30 that has a Joule-Thomson coefficient of less than zero and an inversion temperature at or below that of the ambient temperature of the human environment. The enclosed volume of a loudspeaker system, whether acoustic-suspension or vented Helmholtz resonator type, will determine the compliance of the enclosure, and therefore the position of the resonant frequency of the system. An increase of effective volume therefore will result in a decrease in the resonant frequency in practice because the optimum volume of such an enclosure is very large relative to practical realizations. Such an increase in the effective volume is obtained in adiabatic compression by use of an enclosed gas with a Joule-Thomson coefficient of less than zero. The gas 30 is enclosed in a displaceable walled container 32 composed of an amorphous plastic substance impermeable to said gas 30, which uses an acoustically-driven vibratable membrane 49, such as the electrically-driven vibratable cone 22 of the loudspeaker which is formed from polystyrene or a like plastic and located at a port 48 placed at a location facing the loudspeaker, to form the displaceable wall and which is adapted to seal the gas 30 therein. The displaceable walled container 32 is disposed behind the vibratable cone 22 within the speaker enclosure 11 and fills most of the inner volume thereof. The displaceable walled container is fitted with a valve schematically indicated at 71 which permits replacement of the gas and also if necessary an evacuation preceding such replacement.

Figure 3:
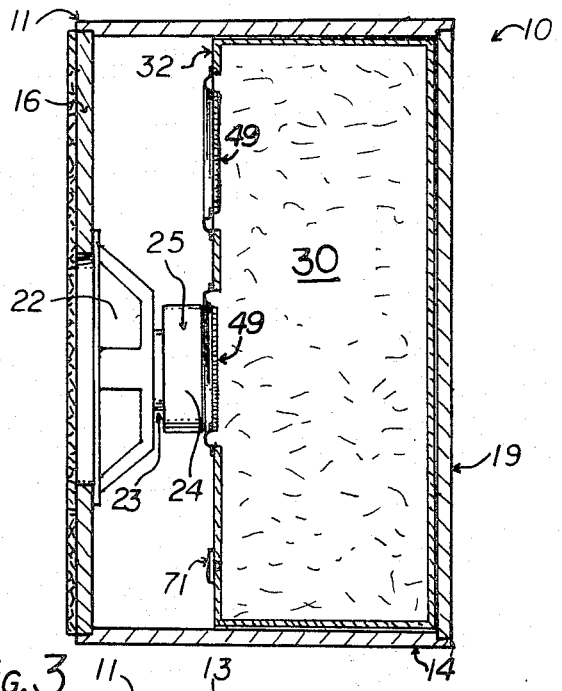
FIG. 2 and FIG. 3 are side elevational views of the speaker enclosure of FIG. 1 showing the device for effectively enlarging its volume, in the form of a collapsible walled container using one or more undriven membranes such as that of the vibratable cone of the loudspeaker to form the collapsible wall of the container.

Referring now to FIG. 3, the speaker enclosure of FIG 2 in which the displaceable walled container 32 which is disposed behind the vibratable cone 22 is fitted with more than one acoustically-driven vibratable membrane 49 placed at the ports 48 in a location facing the vibratable cone 22. This practice allows precision weighting of the aforementioned vibratable membranes 49 in order to allow the varying of the mass of the moving system (22, 49) with respect to frequency in order to allow maximum mass at the low frequencies thereby lowering the position of the low-frequency resonance and allowing minimum mass at higher frequencies thereby providing adequate system damping and raising the quality and accuracy of the sound reproduced.

Figure 5:
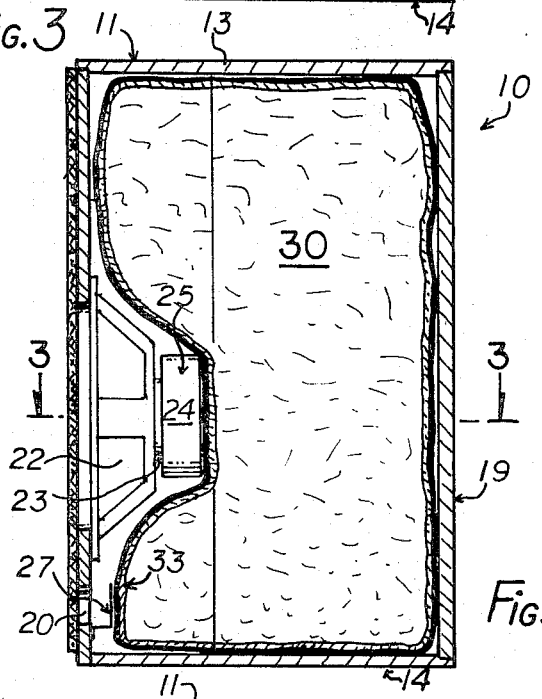
FIG. 5 is a side elevational view of the speaker enclosure of FIG. 1 showing the device for effectively enlarging its volume, in the form of a bag which is formed from a soft and pliable material which is constructed in accordance with the principles of the present invention.
Figure 6:
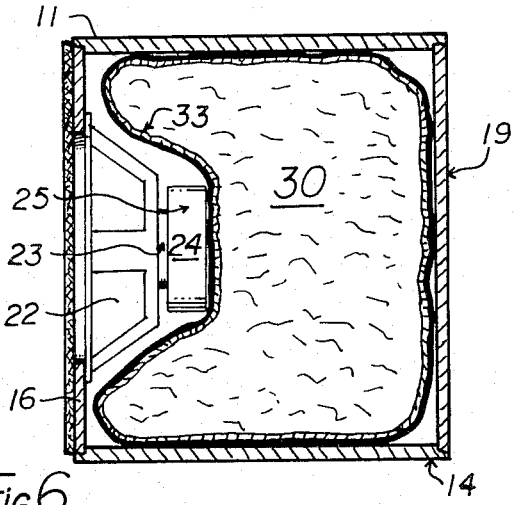
FIG. 6 is a vertical cross-sectional view of the speaker enclosure of FIG. 1 taken along line 3—3 of FIG. 5.

Referring now to FIG. 5, the speaker enclosure 11 of FIG. 2 is fitted with a bag 33 which is formed from a soft, pliable membrane and which is adapted to seal the gas 30 therein. The bag 33 is generally formed from a laminated nylon or some other amorphous polymeric material. The bag 33 is disposed behind the vibratable cone 22 within the speaker enclosure 11 and fills most of the inner volume thereof. Referring to FIG. 5 in conjunction with FIG. 6 one can see how the bag 33 is disposed within the speaker enclosure 11. The bag 33 is prevented from closing off the port 20 of a vented system if desired. The flexibility of the bag material can be designed to provide a means for varying the mass of the moving system (22, 33) in order to maximize the performance of the loudspeaker system 10.

Figure 7:
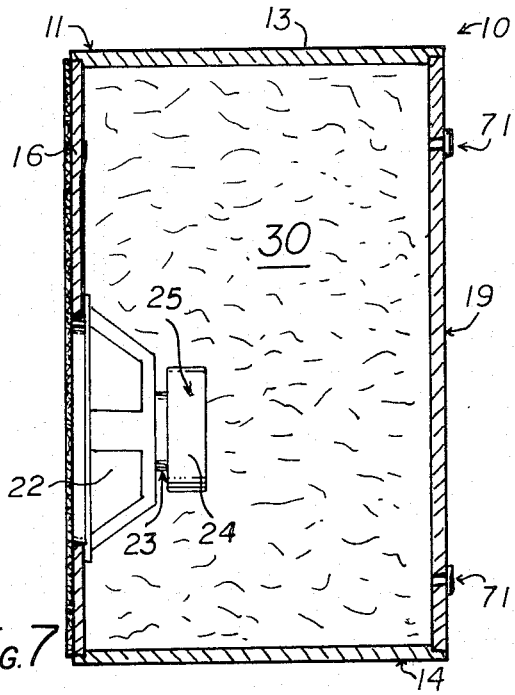
FIG. 7 is a side cross-sectional view of the speaker enclosure of FIG. 1 showing the device for effectively enlarging its volume, in which the enclosure and its vibratorily-driven cone form the walls of the displaceable walled container which is constructed in accordance with the principles of the present invention.

Referring to FIG. 7, the speaker enclosure 11 itself forms the walls of the displaceable walled container, 32 of FIG. 2, and the vibratable cone 22 of the loudspeaker forms the displaceable wall 49 of FIG. 2 and are adapted to seal the gas 30 therein.

Figure 8:
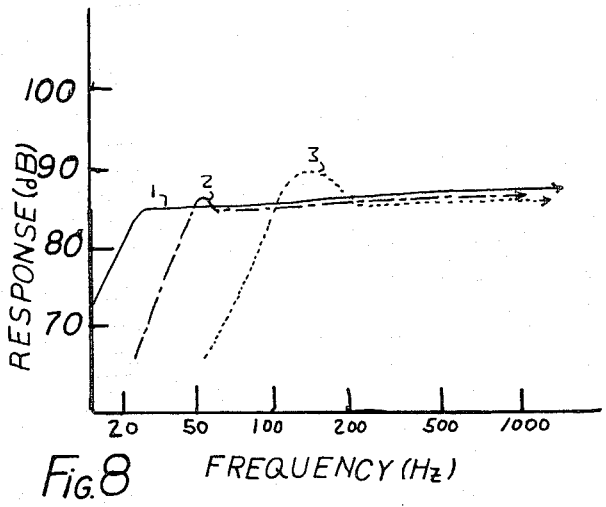
FIG. 8 is a curve diagram showing the sound pressure characteristics of a loudspeaker device constructed in accordance with the principles of the present invention as compared with the characteristics of loudspeakers of equal volume constructed in accordance with the prior art.

Referring now to FIG. 8, the sound pressure vs. frequency response curve of the present invention, curve 1, is compared to that of the response curve of the loudspeaker of the prior art using a gas with a gamma of less than 1.4, curve 2; and the response curve of a loudspeaker of the prior art of the acoustic suspension type, curve 3; each enclosure having the same volume showing the obvious improvement in both low-frequency response and the control of the low-frequency resonance of the loudspeaker system using the principles of the present invention.

Figure 9:
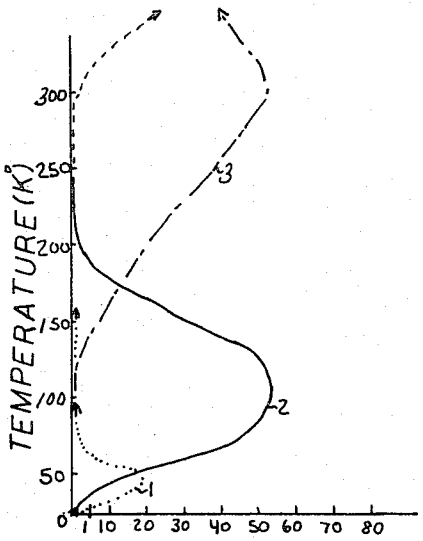
FIG. 9 is a curve diagram of the inversion temperature of the gas Hydrogen as a function of the temperature and pressure of the environment.

Referring now to FIG. 9, this is a graph of the inversion temperature curves of both the gases Helium, curve 1; and Hydrogen, curve 2; which are the gases used in the preferred embodiment of the present invention, as compared to the inversion temperature curve for air, curve 3; which is principally composed of Oxygen and Nitrogen gases.

By referring to this graph, one can seen that at the ambient temperature and pressure of the human environment (293K°, 1 atm) both Helium and Hydrogen gases have curves in which these temperatures and pressures are outside the curves, confirming the fact that these gases have Joule-Thomson coefficients of less than zero in the human environment which makes these gases particularly useful in the present invention. However, Hydrogen gas is particularly volatile and may be dangerous, but Helium gas is an inert gas and also has a speed of sound therein of approximately 3 times that prevailing in air, therefore, Helium is the gas used in the preferred embodiment of the present invention.

In Table I which is set out below the above-mentioned gases are listed with their physical properties that make them useful in the present invention.

TABLE I

| Gas | Tinversion | Speed of Sound | Joule-Thomson Coefficient $\mu$JT (S.T.P) |
|---|---|---|---|
| Helium | 40° K. | 2950 ft/sec | −1.2 |
| Hydrogen | 205° K. | 2150 ft/sec | −.5 |
| Air ($O_2$,$N_2$) | 626° K. | 1130 ft/sec | +.3 |

From the foregoing it can be seen that a device for effectively enlarging the volume of a speaker enclosure has been described. It can also be seen that a means for varying the mass of the moving system of a loudspeaker with respect to frequency has been described. The device is used in combination with a loudspeaker system to increase the compliance that the vibratable membrane or cone sees. Furthermore, it should be noted that schematics of the device have not been drawn to scale and that distances of and between the figures are not to be considered significant. It is to be understood that while the detailed drawings and specific examples given describe preferred embodiments of the invention, they are for the purposes of illustrating the principles of the present invention and that the device of the present invention is not limited to the precise details and conditions disclosed and that various changes may be made therein without departing from the spirit of the invention which is defined by the following claims.

What is claimed is:

1. An improvement for use in combination with a loudspeaker system which includes:

A. a vibratable cone or membrane; and

B. a speaker enclosure having a top, a bottom, a back, a pair of sides and a front having a speaker opening wherein the vibratable cone is mechanically coupled so that it may vibrate in response to an electrical signal, said improvement is a device for effectively enlarging the volume of the speaker enclosure in order to increase the compliance that the vibratable cone sees with said device comprising:

a. a gas having a Joule-Thomson coefficient of less than zero and an inversion temperature less than that of the ambient temperature of the environment in which the device is to be used; and b. a collapsible walled container having an expandable and contractable volume which is used for enclosing said gas within the speaker enclosure and adapted to seal said gas therein and to seal atmospheric gases and water thereout.

2. In a loudspeaker system an improvement for use in combination with a loudspeaker system according to claim 1 wherein said collapsible walled container is in the form of a bag formed from a soft and pliable material for enclosing said gas within the speaker enclosure and adapted to seal said gas therein and to seal atmospheric gases and water thereout.

3. In a loudspeaker system an improvement for use in combination with a loudspeaker system according to claim 1 wherein said collapsible walled container is in the form of the walls and vibratable cone or membrane of the loudspeaker system itself and adapted to seal said gas therein and seal atmospheric gases and water thereout.

4. In a loudspeaker system an improvement for use in combination with a loudspeaker system according to claim 1 wherein the collapsible wall of said collapsible walled container is used to vary the mass of the moving system in relation to frequency.

5. In a loudspeaker system an improvement for use in combination with a loudspeaker system according to claim 2 wherein the flexibility of the material of said bag is used to vary the mass of the moving system with respect to frequency.

6. In a loudspeaker system an improvement for use in combination with a loudspeaker system according to claim 1 wherein the velocity of sound within said gas is greater than the velocity of sound in air.

* * * * *